US006785634B2

(12) United States Patent
Bachrach et al.

(10) Patent No.: US 6,785,634 B2
(45) Date of Patent: Aug. 31, 2004

(54) COMPUTERIZED SYSTEM AND METHODS OF BALLISTIC ANALYSIS FOR GUN IDENTIFIABILITY AND BULLET-TO-GUN CLASSIFICATIONS

(75) Inventors: Benjamin Bachrach, Bethesda, MD (US); Eric van Doorn, Frederick, MD (US)

(73) Assignee: Intelligent Automation, Inc., Rockville, MD (US)

( * ) Notice: Subject to any disclaimer, the term of this patent is extended or adjusted under 35 U.S.C. 154(b) by 48 days.

(21) Appl. No.: 10/336,858

(22) Filed: Jan. 6, 2003

(65) Prior Publication Data

US 2003/0149543 A1 Aug. 7, 2003

Related U.S. Application Data

(63) Continuation-in-part of application No. 09/484,236, filed on Jan. 18, 2000, now Pat. No. 6,505,140.

(51) Int. Cl.[7] ..... G06F 15/00
(52) U.S. Cl. ..... 702/182; 356/153
(58) Field of Search ..... 702/182, 179, 702/166, 167; 356/388, 153, 256, 394, 28, 390, 392, 71

(56) References Cited

U.S. PATENT DOCUMENTS

| | | | |
|---|---|---|---|
| 3,792,354 | A | 2/1974 | Slaught et al. |
| 3,817,096 | A | 6/1974 | Osofky |
| 4,127,055 | A | 11/1978 | Hottinger et al. |
| 4,128,829 | A | 12/1978 | Herbst et al. |
| 4,379,405 | A | 4/1983 | Engeler et al. |
| 4,845,690 | A | 7/1989 | Oehler |
| 4,864,515 | A | 9/1989 | Deck |
| 4,914,289 | A | 4/1990 | Nguyen et al. |
| 5,164,998 | A | 11/1992 | Reinsch |
| 5,349,853 | A | 9/1994 | Oehler |
| 5,381,236 | A | 1/1995 | Morgan |
| 5,390,108 | A | 2/1995 | Baldur et al. |
| 5,413,029 | A | 5/1995 | Gent et al. |
| 5,477,459 | A | 12/1995 | Clagg et al. |
| 5,493,301 | A | 2/1996 | Bossoli et al. |
| 5,512,998 | A | 4/1996 | Puschell |
| 5,531,113 | A | 7/1996 | Jamison |
| 5,638,298 | A | 6/1997 | Edwards |
| 5,654,801 | A | 8/1997 | Baldur |
| 5,659,489 | A | 8/1997 | Baldur |
| 5,713,239 | A | 2/1998 | Kirschner |
| 5,778,725 | A | 7/1998 | Kirschner et al. |
| 5,796,474 | A | 8/1998 | Squire et al. |
| 5,850,289 | A | 12/1998 | Fowler et al. |
| 5,857,202 | A | 1/1999 | Demoly et al. |
| 5,859,700 | A | 1/1999 | Yang |
| 6,018,394 | A | 1/2000 | Baldur |
| 6,020,594 | A | 2/2000 | Tschudi |
| 6,154,562 | A | 11/2000 | Baldur et al. |
| 6,219,437 | B1 | 4/2001 | Baldur |
| RE37,392 | E | 9/2001 | Baldur |
| 6,317,258 | B1 | 11/2001 | Watanabe |
| 6,505,140 | B1 * | 1/2003 | Bachrach ..... 702/166 |

* cited by examiner

*Primary Examiner*—Mark S. Hoff
*Assistant Examiner*—Edward Raymond

(57) ABSTRACT

A computerized system and methods of ballistic analysis involves comparing land impressions on a plurality of control bullets and computing correlation coefficients corresponding to the land-to-land comparisons in all possible relative orientations. A set of matching coefficients is identified for each bullet pair, and the set of matching coefficients is statistically compared to a set of non-matching coefficients. The gun is concluded to be identifiable where the sets of matching coefficients and non-matching coefficients are not statistically undistinguishable. To evaluate whether an evidence bullet was fired by a suspect gun, land impressions on an evidence bullet are compared with land impressions on a plurality of control bullets in all possible relative orientations, and correlation coefficients are computed for each land-to-land comparison to identify a set of questioned coefficients. The evidence bullet is concluded as having been fired by the suspect gun in response to a statistical evaluation that the set of questioned coefficients is statistically equivalent to a set of matching coefficients.

61 Claims, 6 Drawing Sheets

| | NUMBER OF CORRELATION COEFFICIENTS | MEAN | STANDARD DEVIATION |
|---|---|---|---|
| SAME GUN, RIGHT ORIENTATION | 234 | 0.7449 | 0.2013 |
| DIFFERENT GUN | 2720 | 0.3880 | 0.1164 |
| SAME GUN, WRONG ORIENTATION | 232 | 0.3881 | 0.1198 |

FIG.6

| | α | CRITICAL VALUE | TEST STATISTIC | OUTCOME |
|---|---|---|---|---|
| SAME GUN, RIGHT ORIENTATION | 0.10 | 0.1053 | 0.1687 | REJECT Ho |
| SAME GUN, RIGHT ORIENTATION | 0.05 | 0.0880 | 0.1687 | REJECT Ho |
| SAME GUN, RIGHT ORIENTATION | 0.01 | 0.0790 | 0.1687 | REJECT Ho |
| DIFFERENT GUN | 0.10 | 0.0311 | 0.0135 | DO NOT REJECT Ho |
| DIFFERENT GUN | 0.05 | 0.0260 | 0.0135 | DO NOT REJECT Ho |
| DIFFERENT GUN | 0.01 | 0.0233 | 0.0135 | DO NOT REJECT Ho |
| SAME GUN, WRONG ORIENTATION | 0.10 | 0.1058 | 0.0500 | DO NOT REJECT Ho |
| SAME GUN, WRONG ORIENTATION | 0.05 | 0.0883 | 0.0500 | DO NOT REJECT Ho |
| SAME GUN, WRONG ORIENTATION | 0.01 | 0.0793 | 0.0500 | DO NOT REJECT Ho |

FIG.7

| α | CRITICAL VALUE | TEST STATISTIC | OUTCOME |
|---|---|---|---|
| 0.01 | 0.0834 | 0.0534 | DO NOT REJECT $H_2$ |
| 0.05 | 0.0930 | 0.0534 | DO NOT REJECT $H_2$ |
| 0.10 | 0.1115 | 0.0534 | DO NOT REJECT $H_2$ |

FIG.8

| α | CRITICAL VALUE | TEST STATISTIC | OUTCOME |
|---|---|---|---|
| 0.01 | 0.0834 | 0.7585 | REJECT $H_2$ |
| 0.05 | 0.0930 | 0.7585 | REJECT $H_2$ |
| 0.10 | 0.1115 | 0.7585 | REJECT $H_2$ |

FIG.9

COMPUTERIZED SYSTEM AND METHODS OF BALLISTIC ANALYSIS FOR GUN IDENTIFIABILITY AND BULLET-TO-GUN CLASSIFICATIONS

CROSS-REFERENCE TO RELATED PATENT APPLICATION

This application is a continuation-in-part of prior patent application Ser. No. 09/484,236 filed Jan. 18, 2000, now U.S. Pat. No. 6,505,140 the entire disclosure of which is incorporated herein by reference.

BACKGROUND OF THE INVENTION

1. Field of the Invention

The present invention relates generally to computer aided ballistic analysis systems and methods and, more particularly, to a computerized ballistic analysis system and methods in which correlation coefficients obtained by comparing land impression data from the surfaces of bullets is statistically analyzed to evaluate gun identifiability and/or bullet-to-gun classifications.

2. Brief Description of the Related Art

The scratches or striations formed on the surface of a bullet by a gun barrel through which the bullet is fired create a signature with enough unique features that it may be matched with other bullets fired by the same gun. The matching process has been manually accomplished for many years using an optical instrument called a comparison microscope. Manual comparisons of bullets can be quite time consuming and such technique is used sparingly unless there is some reason to believe that a bullet from a crime scene was in fact fired from a gun in question.

Recent machines have been built which attempt to automate the process of ballistics analysis. The goal is to enter bullet images into a database and to allow a computer to search the database for matches. Due to the fact that a computer can make such comparisons many times faster than a human, searching large databases is, at least in principle, feasible. The digitized images of bullets and cartridge cases can also be used to provide additional tools which assist firearms examiners in their manual comparisons.

For example, U.S. Pat. No. 5,654,801 to Baldur describes a fired cartridge illumination method and imaging apparatus which includes a light source and a microscope to image impressions on the surface of the cartridge. Images of the impressions are then used for comparative analysis, during which a first image from a test cartridge and a second image from a computer databank are compared with each other and a maximum correlation value between the first and second images is obtained.

As is common among the current systems capturing data from bullets and cartridges, the devices described in the Baldur patent and in U.S. Pat. No. 5,390,108 to Baldur et al capture strictly visual data which does not distinguish between shallow scratches or deep scratches on the surface of the examined cartridge or bullet. Therefore, important analysis parameters are not considered, which lessens matching reliability and reduces provability of consistent conclusions.

A fundamental problem of all computer aided ballistic analysis systems is that bullets fired from the same gun do not match exactly for a number of reasons, including the facts that the cartridge casing may have different amounts of powder, or that the gun barrel may have been at different temperatures when bullets are fired as compared to the test firing. Due to the fact that the impressions made by a gun on a bullet can differ from firing to firing, all comparison algorithms must necessarily be statistical and cannot look for an exact or even nearly exact match of all striations on the bullet's surface.

Currently, the algorithms which compare bullets have a high false positive match rate. Qualitatively, this means that automatic searching of a large database of ballistic data which may have tens of thousands of entries is not viable. By using the large database, there would be so many false positive matches requiring so many comparisons that essentially no useful information would be obtained. Another problem of current algorithms used in ballistic analysis involves the false negative match rate, resulting in reliable evidence being missed.

The poor false match rate using current algorithms is the result of fundamental problems, most of which are associated with the fact that the data used for the bullet comparisons is 2-D data as represented by the Baldur and Baldur et al patents. 3-D data is much more reliable and robust than 2-D data. In 2-D data capture, a source of light is directed at the bullet's surface, and a camera records the light as it is reflected by that surface. The data capture process is based on the fact that the light reflected by the bullet's surface is a function of its surface features. However, this is an indirect measurement because it involves a transformation of the incident light into the light recorded by the camera. By comparison, a 3-D acquisition process is simply the distance between the surface features and an imaginary plane, and is thus a direct measurement. The disadvantages associated with the indirectness of 2-D data capture are:

Robustness: A significant problem associated with 2-D data capture lies in the fact that the transformation relating the light incident on the bullet's surface and the light reflected by it depends not only on the features of the bullet's surface, but also on a number of independent parameters such as the angle of incidence of the light, the angle of view of the camera, variations on the reflectivity of the bullet's surface, light intensity, et cetera. This implies that the captured data (the data recorded by the camera) is also dependent on these parameters. To attempt to eliminate the effect of these parameters on the captured data would be next to impossible, except possibly for light intensity. As a consequence, the 2-D captured data is vulnerable to considerable variability or, in other terms, it is non-robust.

Indeterminate conditions: A different kind of problem associated with 2-D data capture is the presence of indeterminate conditions in the data. Given an incident light source angle, some of the smaller surface features can be "shadowed" by the larger features. This implies that there will be regions of the surface where the captured data will not accurately reflect the surface features. In mathematical terms, the transformation between the incident light and the reflected light is non-invertible. Furthermore, this is an example where the angle of incidence of the light source can have a critical effect on the captured data, because arbitrarily small changes in the angle of incidence may determine whether smaller features are detected or not. In mathematical terms, the transformation between the incident light and the reflected light is discontinuous with respect to the angle of incidence.

In summary, 2-D data capture methodologies can be affected by extraneous variables that can be next to impossible to control. Moreover, because these variables are not measured, their effects on the captured data cannot be compensated for. As a consequence, the normalized data resulting from some capture processes is also vulnerable to significant variability or, in other words, lack of repeatability. The performance of even the most sophisticated correlation algorithms will be degraded in the presence of non-repeatable data. Taking in consideration that the bullet matching problem is quite demanding to begin with, it is not surprising that ballistic matching methodologies based on 2-D captured data have had significant difficulties delivering satisfactory performance.

SUMMARY OF THE INVENTION

Accordingly, it is a primary object of the present invention to overcome the disadvantages of prior ballistic analysis systems and methods and, in particular, prior computer aided ballistic analysis systems and methods.

Another object of the present invention is to perform ballistic analysis utilizing 3-D information of a bullet's surface.

A further object of the present invention is to perform ballistic analysis by comparing at least the land impressions of two or more bullets and, in particular, by comparing fine details within the land impressions.

An additional object of the present invention is to determine whether a gun is identifiable utilizing matching coefficients and non-matching coefficients obtained by comparing the land impressions of a plurality of control bullets fired by the gun.

It is also an object of the present invention to utilize matching coefficients, obtained by comparing the land impressions of a plurality of control bullets fired by a gun, and questioned coefficients, obtained by comparing the land impressions of an evidence bullet to the land impressions of the control bullets, to classify the evidence bullet as a match or non-match with the suspect gun.

The present invention has as another object to perform gun identifiability by evaluating the statistical similarity between a set of control bullet matching coefficients and a set of non-matching coefficients.

Yet a further object of the present invention is to evaluate gun identifiability by calculating the similarity between the probability distributions of a set of matching coefficients for control bullets fired by the gun and a set of non-matching coefficients.

Moreover, it is an object of the present invention to classify a bullet in relation to a suspect gun by evaluating the statistical similarity between a set of control bullet matching coefficients and a set of questioned coefficients.

The present invention has as an additional object to classify a bullet in relation to a suspect gun by evaluating the statistical similarity between a set of control bullet matching coefficients and a set of non-matching coefficients.

It is an additional object of the present invention to utilize either different-gun coefficients or same-gun non-matching coefficients as non-matching coefficients in ballistic analysis.

The present invention has as an additional object to estimate the probabilities of error in computerized ballistic analysis.

Some of the advantages of the present invention are that time consuming, manual comparisons of bullets by firearms examiners can be replaced with an automated procedure for gun identifiability and/or bullet-to-gun classifications; conventional statistical tests can be used in the system and methods of the present invention; various algorithms or other mathematical operations can be used in the present invention to compute correlation coefficients for land-to-land comparisons between bullets; ballistic analysis can be performed using only land-to-land comparisons between bullets; ballistic analysis can be performed using groove impression comparisons and/or other bullet impression comparisons in addition to land impression comparisons; human subjectivity and error are eliminated from ballistic analysis; the databases used in the system and methods of the present invention can store land impression data and correlation coefficients for a great number of different bullets to provide a reference database from which specific land impression data and/or correlation coefficients may be accessed on demand; ballistic analysis may be simplified by using same-gun non-matching coefficients as a substitute for different-gun coefficients; although the use of 3-D depth profiles is preferred, 2-D data of the surfaces of bullets can be used in the present invention; any number of control bullets greater than one can be used in the present invention; and various methodology can be used to identify the matching coefficients, the non-matching coefficients and the questioned coefficients.

These and other objects, advantages and benefits are realized with the present invention as generally characterized in a computerized system for ballistic analysis comprising a data acquisition unit for acquiring data of a bullet's surface and, in particular, land impression data of a bullet's surface, and a data processor having software for statistically comparing land impression data of the surfaces of a plurality of bullets to one another. To evaluate the identifiability of a suspect gun, the data processor compares land impression data of the surfaces of a plurality of control bullets, fired by the suspect gun, to one another in all possible relative orientations for the control bullets. The data processor computes a correlation coefficient for each land-to-land comparison between the control bullets and identifies a set of matching coefficients for the control bullets corresponding to the correlation coefficients in which each pair of the control bullets is in a relative orientation of greatest match. The data processor also identifies a set of non-matching coefficients, which may comprise a set of same-gun non-matching coefficients for the control bullets or a set of different-gun coefficients. The data processor statistically evaluates whether or not the sets of matching coefficients and non-matching coefficients are statistically indistinguishable, and a Rank-Sum test may be used for the statistical evaluation. The data processor concludes the suspect gun as being identifiable in response to a statistical evaluation that the sets of matching coefficients and non-matching coefficients are not statistically undistinguishable.

The computerized system for ballistic analysis may be used to classify an evidence bullet with respect to a suspect gun, and the data processor includes software for comparing land impression data of the surface of at least one evidence bullet with land impression data of the surfaces of a plurality of control bullets in all possible relative orientations for the evidence bullet and the control bullets. The data processor computes a correlation coefficient for each land-to-land comparison between the evidence bullet and the control bullets, respectively, and identifies a set of questioned coefficients for the evidence bullet and the control bullets. The data processor statistically evaluates whether or not a set of matching coefficients for the control bullets is statistically equivalent to the set of questioned coefficients. The data processor concludes that the evidence bullet was fired by the suspect gun in response to a statistical evaluation that the sets of matching coefficients and questioned coefficients are statistically equivalent. A set of non-matching coefficients, either same-gun non-matching coefficients for the control bullets or different-gun coefficients, may be statistically evaluated by the data processor for statistical equivalence to the set of questioned coefficients, and the data processor concludes that the evidence bullet was not fired by the suspect gun in response to a statistical evaluation that the sets of non-matching coefficients and questioned coefficients are statistically equivalent.

In the computerized system for ballistic analysis of the present invention, 3-D depth profiles are preferably used for the land-to-land comparisons, including fine details within the land impressions. The system may include a filter or other means for isolating features of the land impressions within intermediate length scales. In addition, the system may include normalization software for compensating the acquired depth profiles for various measurement errors. Various correlation algorithms or other mathematical functions or operations may be used in the computerized system for ballistic analysis to calculate the correlation coefficients as a quantitative measure of the similarity of the land impressions under comparison. Various methodologies may be used to identify the matching coefficients, the non-matching coefficients and the different-gun coefficients.

A method of computerized ballistic analysis in accordance with the present invention comprises the steps of comparing land impressions on the surfaces of a plurality of control bullets, fired by a suspect gun, to one another in all possible relative orientations for the control bullets and computing a correlation coefficient for each land-to-land comparison. A set of matching coefficients is identified corresponding to the correlation coefficients in which each pair of the control bullets is in a relative orientation of greatest match. A set of non-matching coefficients is identified and may involve identifying a set of different-gun coefficients obtained by comparing the land impressions of a plurality of bullets fired by different guns of the same model as the suspect gun or a set of same-gun non-matching coefficients corresponding to the correlation coefficients in which each pair of the control bullets is in a non-matching relative orientation of less than greatest match. The method further comprises statistically evaluating whether or not the sets of matching coefficients and non-matching coefficients are statistically undistinguishable and concluding the suspect gun is identifiable in response to a statistical evaluation that the sets of matching coefficients and non-matching coefficients are not statistically undistinguishable.

Another method of the present invention involves comparing land impressions on the surface of at least one evidence bullet with the land impressions on each of a plurality of control bullets, fired by a suspect gun, in all possible relative orientations between the evidence bullet and the control bullets, computing a correlation coefficient for each land-to-land comparison between the evidence bullet and the control bullets, respectively, and identifying a set of questioned coefficients for the evidence bullet and the control bullets. A set of matching coefficients for the control bullets is statistically evaluated with the set of questioned coefficients to determine whether or not the set of matching coefficients is statistically equivalent to the set of questioned coefficients. Where the statistical evaluation presents the sets of matching coefficients and questioned coefficients as being statistically equivalent, it is concluded that the evidence bullet was fired by the suspect gun. The method of the present invention may further include statistically evaluating whether or not a set of non-matching coefficients, either different-gun coefficients or same-gun non-matching coefficients, is statistically equivalent to the set of questioned coefficients and concluding the evidence bullet was not fired by the suspect gun in response to a statistical evaluation that the sets of non-matching coefficients and questioned coefficients are statistically equivalent. Various numbers of control bullets greater than one can be used in the methods of the present invention for gun identifiability and/or bullet-to-gun classification. Various numbers of evidence bullets can be classified in relation to a suspect gun using the methods of the present invention.

BRIEF DESCRIPTION OF THE DRAWINGS

FIG. 6 is a table depicting some of the basic statistical properties of the three different sets of correlation coefficients shown in FIG. 5.

FIG. 7 is a table depicting the results of a Kolmogorov-Smirnov (KS) test performed on the correlation coefficients of FIG. 5.

FIG. 8 is a table illustrating the results of a Kolmogorov-Smirnov test performed on the different-gun coefficients and same-gun non-matching coefficients.

FIG. 9 tabulates the results of a Kolmogorov-Smirnov test performed for the different-gun coefficients and the matching coefficients.

DETAILED DESCRIPTION OF THE PREFERRED EMBODIMENTS

Figure 1:
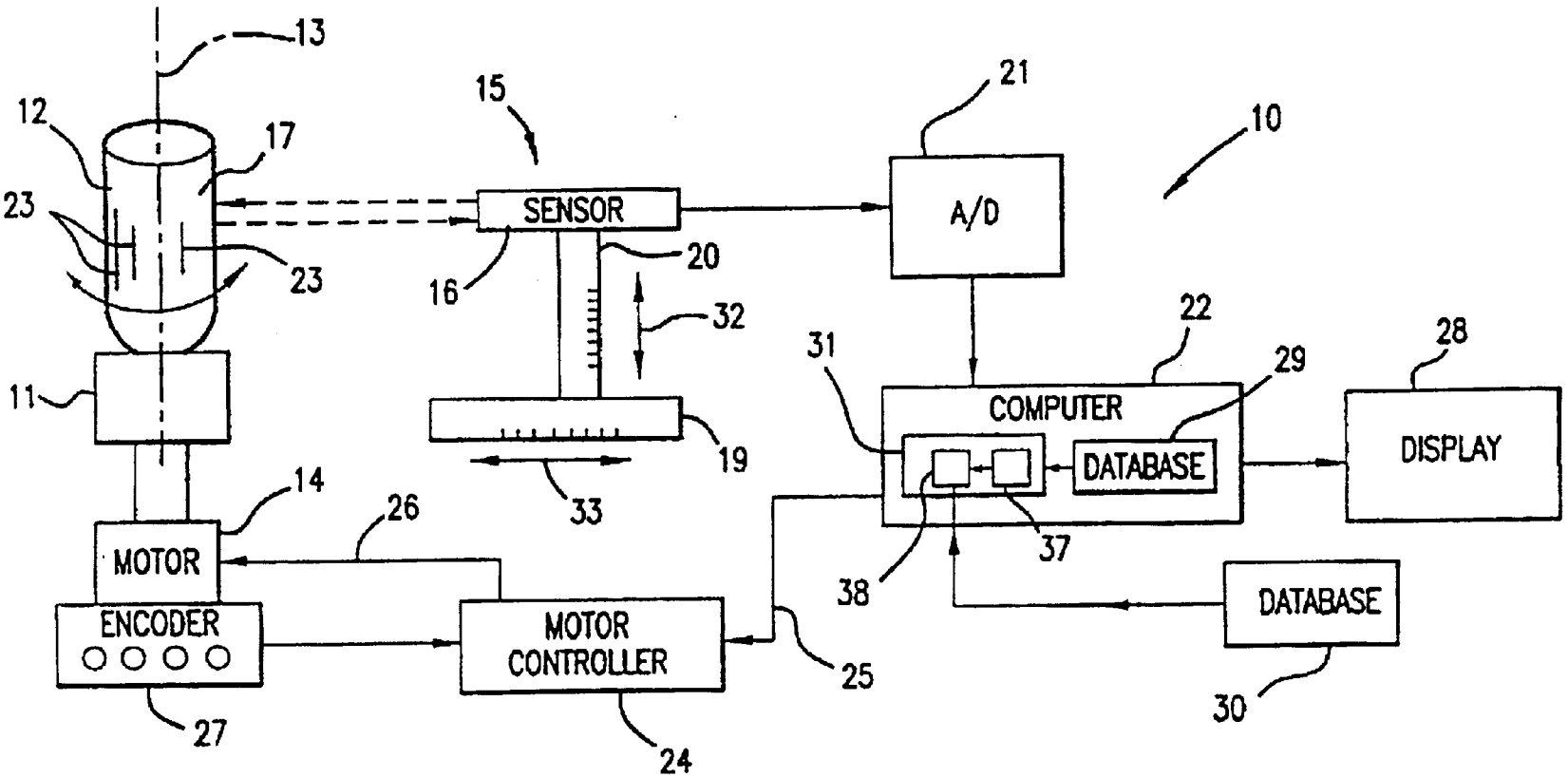
FIG. 1 is a block diagram representing a computerized system for ballistic analysis according to the present invention.

The computerized system and methods for ballistic analysis according to the present invention utilize land impression data from the surfaces of bullets and, preferably, acquired and normalized 3-D data from the surfaces of bullets, to evaluate the identifiability of a gun and/or bullet-to-gun classifications. Although the use of 3-D depth profile data is preferred, it should be appreciated that 2-D data can be used in the present invention. 3-D data from the surfaces of bullets may be acquired and normalized as described generally herein and as disclosed in greater detail in co-pending patent application Ser. No. 09/484,236 filed Jan. 18, 2000, the entire disclosure of which was previously incorporated herein by reference. As illustrated in FIG. 1, a computerized system 10 according to the present invention includes a mechanism 11 for holding a bullet 12 under examination coaxial or substantially coaxial with the axis of rotation 13 of a motor 14, a data acquisition unit 15 having a depth sensor 16 for measuring the distance between the data acquisition unit and the surface 17 of the bullet 12, and a data processor 22. The bullet 12 may be an evidence bullet for which classification is desired, a reference or control bullet, or a different-gun bullet as explained further below.

The holding mechanism 11 may comprise a cup filled with a holding material such as a wax or clay-type holding material. The bullet 12 is depicted in FIG. 1 installed in the cup upside down and held by the holding material preferably coaxial to the cup, i.e., centered and vertical to the holding mechanism 11. In the case of a structurally intact bullet, the bullet may be positioned in the holding mechanism 11 right side up so as to be balanced by its own weight, and may be held in place with a holding material such as double-sided adhesive tape disposed between the bullet and the holding mechanism. Where the bullet is damaged and cannot stand on its own, wax may be used as the holding material to secure the bullet right side up in the holding mechanism. The holding mechanism 11 is rotated by the motor 14 such that the bullet 12 held by the holding mechanism is also rotated therewith. The motor 14 may rotate the bullet continuously or intermittently in a step-wise manner as described further below.

The data acquisition unit 15 includes depth sensor 16 and micro-positioner stages 19 and 20 for selectively positioning the depth sensor relative to the bullet 12 held by the holding mechanism 11. The depth sensor 16 acquires data corresponding to depth profiles of striations 23 on the surface 17 of the bullet 12, including the land impressions on the surface of bullet 12. Confocal based sensors are preferred for use as the depth sensor in the present invention; however, other sensors offering appropriate resolutions and depth ranges may be used.

The micro-positioner stages 19 and 20 position the depth sensor 16 to measure a cross-section of the bullet 12. The micro-positioner stage 19 allows movement of the depth sensor 16 toward and away from the axis of rotation 13 as shown by arrow 33 in FIG. 1. The micro-positioner stage 20 allows movement of the depth sensor 16 along the axis of rotation 13 as shown by arrow 32 in FIG. 1. The depth sensor 16 may also be positionable or adjustable in a direction perpendicular to arrows 32 and 33 and an additional micro-positioner stage may be provided for this purpose. The micro-positioner stages may be motor driven or manually actuated and, in one preferred embodiment, the micro-positioner stages are motor driven and controlled by data processor 22.

Data acquired by the depth sensor 16 may be transmitted to an A/D converter 21 which digitizes the data and transfers the digitized data to the data processor 22, which may comprise one or more processors or computers. It should be appreciated, however, that an A/D converter is not essential to the present invention. Where the bullet 12 is rotated continuously, depth profile measurements of the bullet's surface are made by the depth sensor 16 continuously along the circumference or cross-section of the bullet and this data may be continuously transferred to the data processor 22. Where the bullet 12 is rotated in a step-wise manner, the bullet is intermittently stopped and depth profile measurements may then be taken within a certain area. This data may intermittently be transferred to the data processor 22, wherein software 31 is used to "piece together" a full depth profile of the bullet's circumference or cross-section. A motor controller 24 is coupled to the data processor 22 for receiving a signal 25 therefrom, in response to which the motor controller provides a control signal 26 to the motor 14 dictating either constant speed motion of the motor 14 for continuous rotation of the bullet 12 or motion in a step-wise manner for intermittent or step-wise rotation of the bullet 12. An encoder 27 may be associated with motor 14 to provide an accurate position readout allowing the motor controller 24 to maintain constant speed or to stop the motor at fixed positions. For best results, measurements should be taken of the depth profiles of several cross-sections or circumferences of the bullet, i.e. at different positions along the longitudinal axis of the bullet. These depth profiles can be averaged as a single "ring", circumference or cross-section or as different "rings", circumferences or cross-sections.

A database 29 of data processor 22 stores depth profile data of striations 23 on the surface 17 of the bullet 12 received from the data acquisition unit. A display 28 may be provided comprising a computer display presenting a graphical user interface (GUI) to display depth profiles measured and processed. An optional database 30 may be provided storing depth profile data for one or more reference or control bullets and/or different-gun bullets. The database 30 may be filled with reference data simultaneously with measurements taken during examination of the bullet 12. Of course, data stored in database 30 should be acquired and processed in a manner substantially similar to the manner in which data is acquired and processed for the bullet under examination.

Software 31 may comprise an acquisition component 37 responsible for acquiring the depth profile data from the bullet's surface and preparing it for analysis. The acquisition component 37 may include all software elements required to control hardware components for capturing depth profile data from the bullet's surface, to encode or digitize the depth profile data in a format that can be stored and manipulated by the data processor, and to process the encoded or digitized data in preparation for analysis and comparison. As described in the co-pending patent application previously incorporated herein by reference, the software elements used to process the encoded or digitized depth profile data in preparation for analysis and comparison may include normalization software for normalizing the depth profile data to compensate for measurement errors including off-centeredness, tilt and/or deformation of the bullet under examination. The normalized depth profile data provides a "signature" of the bullet which can be compared with the "signatures" of one or more other bullets.

The data processor 22 further comprises software 38 responsible for comparing the land impressions of bullets, and preferably the 3-D depth profiles of the land impressions of bullets, to one another in all relative orientations, for computing correlation coefficients for each land-to-land comparison, for identifying matching coefficients, non-matching coefficients, i.e. same-gun non-matching coefficients and/or different-gun coefficients, and questioned coefficients, for performing statistical tests on sets of the correlation coefficients, for evaluating the results of the statistical tests and, based on the evaluations, for concluding whether or not a suspect gun is identifiable and/or whether or not an evidence bullet was fired by a suspect gun. The functions and operations performed by the data processor are described below in greater detail.

Figure 2:
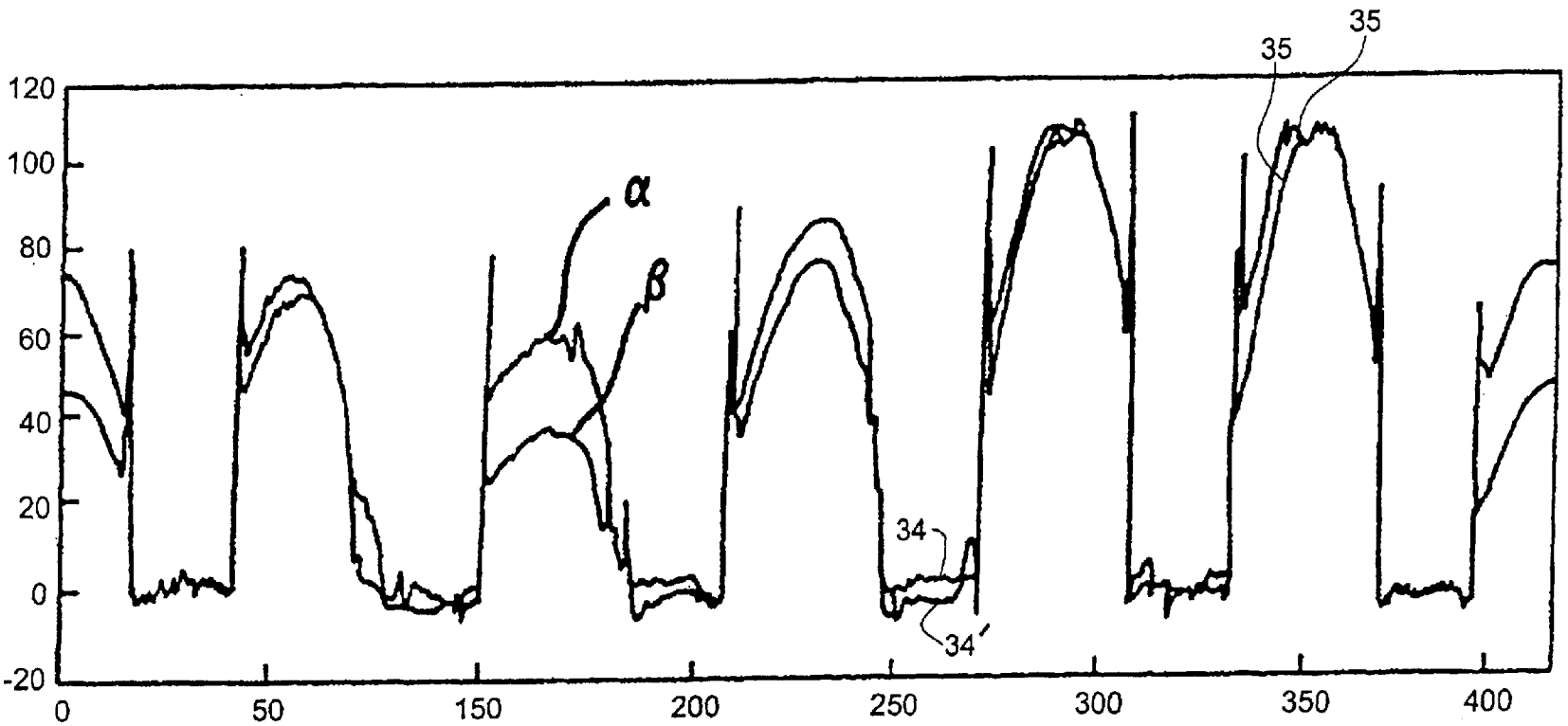
FIG. 2 illustrates the depth profiles for two bullets superimposed in their matching relative orientation.

FIG. 2 illustrates the signatures of two bullets $\alpha$ and $\beta$ fired by the same gun, with their depth profiles superimposed in their matching relative orientation. Each depth profile comprises six land impressions 34, 34' and six groove impressions 35, 35'. In the matching relative orientation for bullets $\alpha$ and $\beta$ the land impressions 34 for bullet $\alpha$ are aligned with the land impressions 34' for bullet $\beta$ in the relative orientation of greatest similarity or match. The computerized ballistic analysis system and methods of the present invention involve inspecting and comparing the normalized land impressions of two bullets in all possible relative orientations and calculating correlation coefficients for each land-to-land comparison. Various correlation algorithms or other mathematical operations can be incorporated in the software of data processor 22 to compute the correlation coefficients. The software of data processor 22 preferably makes comparisons not only of the major features of the land impressions for the two bullets but also of the smaller, fine details found within the land impressions, since the fine details found within the land impressions have proven to be the most reliable source of information on which to base comparisons between the bullets. The software of data processor 22 may also make comparisons between the groove impressions for the two bullets, including fine details within the groove impressions, and/or other impressions on the surfaces of the two bullets. The correlation coefficients are computed for the land impressions of the bullets under comparison in all possible relative orientations and, given bullets $b_i$ and $b_j$, the correlation coefficient $s(I_{is}, I_{jt})$ between land impressions $I_{is}$ (the $s^{th}$ land impression of bullet i) and land impression $I_{jt}$ (the $t^{th}$ land impression of bullet j), is defined as follows:

$$s(l_{is}, l_{jt}) = \max_{|\Delta x|<\Delta x_{\max}} \left[1 - \frac{\|l_{is}(x+\Delta x) - l_{jt}(x)\|^2}{\|l_{is}(x+\Delta x) + l_{jt}(x)\|^2}\right]_{\Delta X}$$

where $\|x\|$ is the Euclidian vector norm of vector x and $\Delta x_{max}$ is a maximum amount of lateral displacement allowed for correlation. The maximum correlation is found empirically by displacing or shifting one data set with respect to the other by $\Delta x$, since the starting point of each acquired land impression is controlled by a human operator and is therefore not strictly fixed. The definition proposed for the correlation coefficient has the advantage of using the entire land impression in an unambiguous way and is not limited to integer values. Since each land-to-land comparison renders one correlation coefficient, a pair of bullets with k rifling impressions will have k correlation coefficients for each of the k possible relative orientations between the pair of bullets. Accordingly, the matrix $S(I_i, I_j)$ is defined as follows:

$$S(l_i, l_j) = \begin{bmatrix} s(l_{i1}, l_{j1}) & s(l_{i2}, l_{j2}) & \dots & s(l_{ik}, l_{jk}) \\ s(l_{i1}, l_{j2}) & s(l_{i2}, l_{j3}) & \dots & s(l_{ik}, k_{j1}) \\ \vdots & \vdots & \ddots & \vdots \\ s(l_{i1}, l_{jk}) & s(l_{i2}, l_{j1}) & \dots & s(l_{ik}, l_{jk-1}) \end{bmatrix}$$

Each row of matrix $S(I_i, I_j)$ corresponds to the correlation coefficients obtained by comparing the land impressions of bullets i and j in a particular relative orientation. The $p^{th}$ row of matrix $S(I_i, I_j)$ may be denoted as $[S(I_i, I_j)]_p$, and may be referred to as the $p^{th}$ relative orientation.

The most repeatable land impression features reside within the intermediate length scales for the land impressions. The longest length scales (on the scale of an entire land impression) may be corrupted by large-scale deformation, particularly in the case of damaged bullets. Shorter length scales (~micron) may be influenced by non-repeatable circumstances during firing such as dust or gunpowder residue in the gun barrel or sensor noise during acquisition of the data. Accordingly, the correlation coefficients may be improved by using a band-pass filter, such as a Butterworth band-pass filter, in the system and methods of the present invention to filter the acquired depth profile data and isolate features of the most repeatable length scales, i.e. the intermediate length scales.

Figure 3:
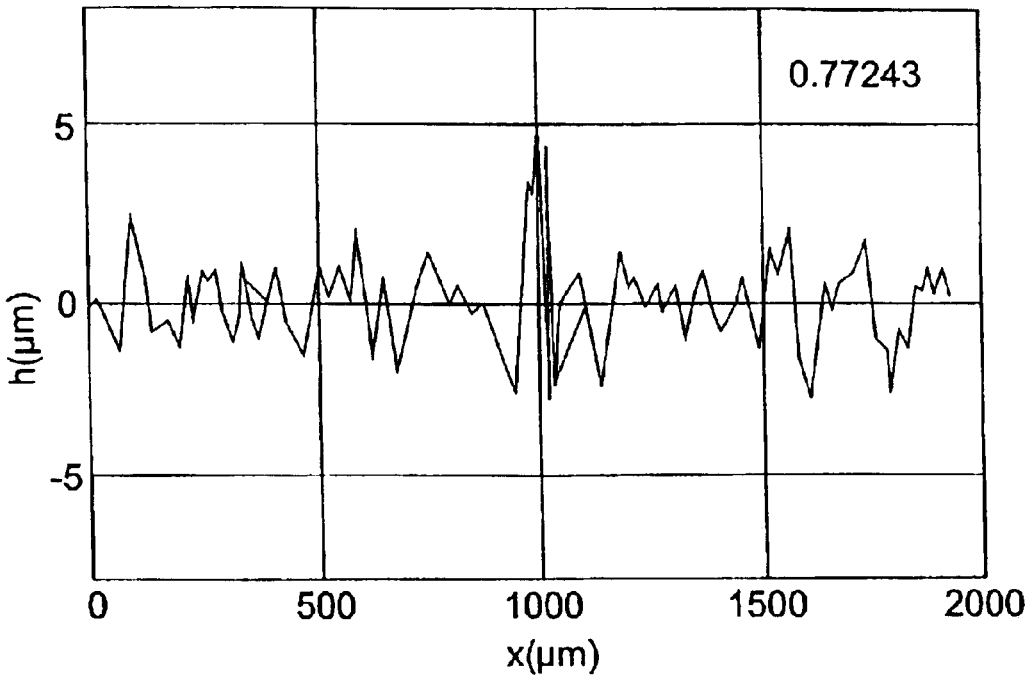
FIG. 3 is a plot of a single, filtered land impression profile for a first bullet superimposed over a single, filtered land impression profile for a second bullet, fired by the same gun, in their matching relative orientation.
Figure 4:
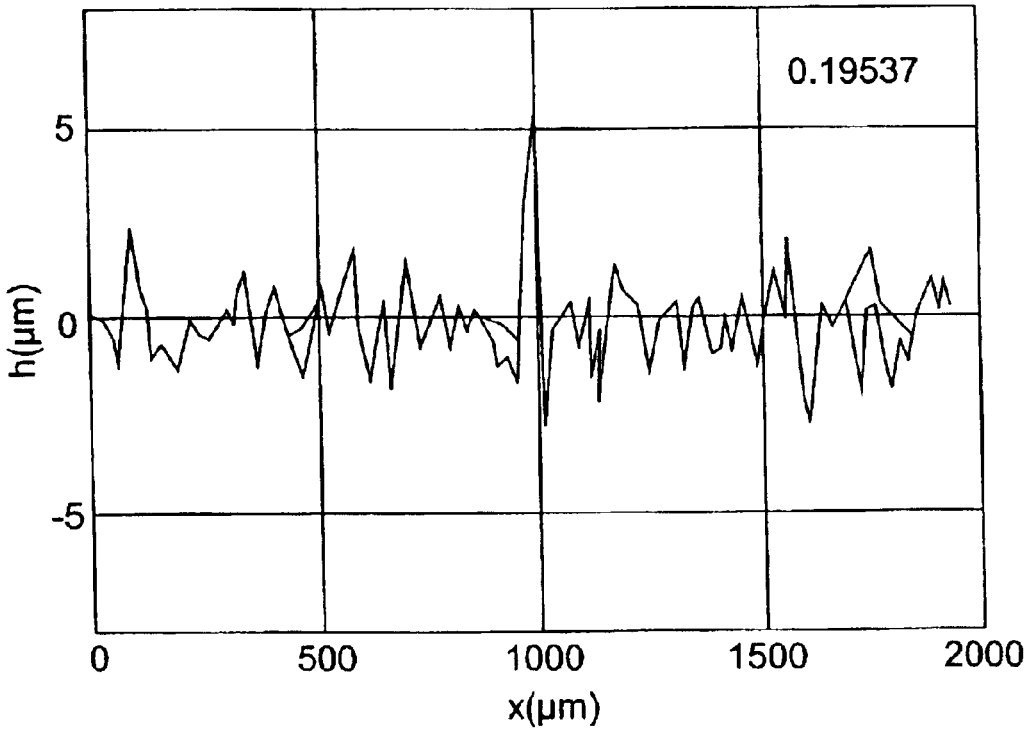
FIG. 4 is a plot of a single, filtered land impression profile of a first bullet superimposed over a single, filtered land impression profile of a third bullet, fired by different guns.

FIG. 3 illustrates a plot of a land impression for a first bullet superimposed over the land impression for a second bullet, after processing and filtering, for a pair of bullets in their matching relative orientation and fired by the same gun. The correlation coefficient for this land-to-land comparison is displayed at the upper right corner of the plot. The same type of plot is illustrated in FIG. 4 showing the land impression of the first bullet superimposed over the land impression of a third bullet fired by a different gun. Where the bullets under comparison have six land impressions, for example, six plots may be generated corresponding to the six land-to-land comparisons for the bullets in their matching relative orientation. It is seen from FIGS. 3 and 4 that the correlation coefficients for the land impressions of bullets fired by the same gun are, on average, higher than those for bullets fired by different guns. In other words, correlation coefficients for bullets fired by the same gun, when computed in their matching relative orientation, are expected to be higher than those obtained for pairs of bullets fired by different guns, when computed in their matching relative orientation.

In the system and methods of the present invention, correlation coefficients are computed between the land impressions of at least two bullets to obtain the matrix $S(I_i, I_j)$ as discussed above. In the case of bullets with six rifling impressions, the matrix $S(I_i, I_j)$ will be a six by six matrix. Since each row of the matrix $S(I_i, I_j)$ corresponds to a possible relative orientation between the two bullets, the matching relative orientation, i.e. the relative orientation of greatest similarity or match, may be identified by the data processor 22 as the row that yields the highest mean correlation coefficient. The correlation coefficients for the row selected as the matching relative orientation constitute matching coefficients (or same gun, right orientation coefficients) for the pair of bullets under comparison. Matching coefficients for two bullets fired by the same gun are the correlation coefficients corresponding to the relative orientation in which the computed correlation coefficients correspond to pairs of land impressions created by the same land of the gun's barrel. For n guns, each firing m bullets and bearing k land impressions, there are $$n \times \left(\frac{m!}{(m-2)! \times 2!}\right) \times k \quad \text{matching coefficients}$$

Matching coefficients can be identified in various ways other than or in addition to identifying the highest mean correlation coefficient. For example, matching coefficients can be identified by identifying the row of correlation coefficients having the highest median correlation coefficient, by averaging some or all of the correlation coefficients in each row and comparing the resulting averages or by comparing the correlation coefficients of each row statistically. When averaging is used, one or more of the lowest coefficients may be dropped from each row prior to averaging the remaining coefficients in each row.

Non-matching coefficients are correlation coefficients obtained from other land-to-land comparisons. Two different types of land-to-land or land impression comparisons result in non-matching coefficients. The first type of land impression comparison yielding non-matching coefficients involves comparing land impressions from at least two bullets fired by two different guns of the same manufacture and model. As in the computation of matching coefficients, the relative orientation having the highest mean correlation coefficient may be identified, and the correlation coefficients for the relative orientation having the highest mean correlation coefficient may be identified as different-gun coefficients, although other methodologies may be used to identify the different-gun coefficients as explained above for the matching coefficients. Different-gun coefficients, therefore, correspond to the correlation coefficients for the relative orientation of greatest similarity or match between the land impressions of at least two bullets fired by different guns of the same manufacture and model. For n guns, each firing m bullets and bearing k land impressions, there are $$\left(\frac{n!}{(n-2)!\times 2!}\right)m^2\times k \quad \text{different-gun coefficients.}$$

The second type of land impression comparison yielding non-matching coefficients involves comparing land impressions from at least two bullets fired by the same gun but in a non-matching relative orientation in which the compared land impressions are created by different lands of the gun's barrel. For bullets having six land impressions each, there are five relative orientations in which the compared land impressions are created by different lands of the gun's barrel, the sixth possible relative orientation being the matching relative orientation associated with the matching coefficients. From the five relative orientations in which the compared land impressions are formed by different lands of the gun's barrel, the relative orientation that yields the highest mean correlation coefficient may be selected, and the corresponding correlation coefficients may be identified as same-gun non-matching coefficients (or same gun, wrong orientation coefficients). Accordingly, the same-gun non-matching coefficients correspond to the relative orientation of less than greatest match and may be derived from the relative orientation with the second highest mean correlation coefficient or by using other methodologies as explained above for the matching coefficients and different-gun coefficients. For n guns, each firing m bullets bearing k land impressions, there are $$n\times\left(\frac{m!}{(m-2)!\times 2!}\right)\times k \quad \text{same-gun non-matching coefficients.}$$

Whether evaluating the individuality or identifiability of guns or matching an evidence bullet with a suspect gun, the statistical distribution of different-gun coefficients provides a baseline or reference of the expected distribution of correlation coefficients when comparing bullets fired by different guns of the same model as a suspect gun. In other words, the distribution of different-gun coefficients permits computation of the probability of a false identification. Ideally, the distribution of different-gun coefficients should be obtained by comparing bullet pairs from a judiciously selected sample of guns of the same make and model as the suspect gun. The collection of such information, although possible, would entail a significant effort and may not be readily available to a firearms examiner. In view of this problem, it would be desirable to estimate the distribution of different-gun coefficients from more readily available data. Given that different-gun coefficients are the result of comparing land impressions from different guns manufactured by the same processes as the suspect gun, the degree of similarity between land impressions found on bullets fired by different guns of the same make should be approximately that of land impressions found on a single gun of such manufacture but compared on the non-matching relative orientation. If a gun (barrel) leaves sufficiently repeatable and, therefore, identifiable, impressions on the surface of the bullets fired by it, matching coefficients will be distributed differently from non-matching coefficients, either same-gun non-matching coefficients or different-gun coefficients, and will attain, on average, higher values than non-matching coefficients. Accordingly, the distribution of different-gun coefficients can be approximated by that of same-gun non-matching coefficients as represented by the following example.

Ten guns of the same model (9 mm P85 Ruger Pistol) were used to fire thirty-five bullets. The barrels of the guns were not only of the same model but were consecutively manufactured, making them as similar as possible to one another. Twenty of the thirty-five bullets were provided as control bullets, i.e. bullets of known origin, with each barrel having been used to fire two control bullets. The remaining fifteen bullets were provided as evidence bullets, i.e. questioned or suspect bullets, to be matched with the guns from which they were fired. Depth profile data of the land impressions of the bullets was acquired by scanning with lateral resolution of 6 mm, although in some cases not all land impressions were acquired. Preprocessing corrected for the curvature of the bullets' surfaces and eliminated land impressions of poor quality. The average number of points for each land impression was 2000 data points, corresponding to 1.2 mm. The average number of land impressions fit for comparison was 5.45 per bullet.

Figure 5:
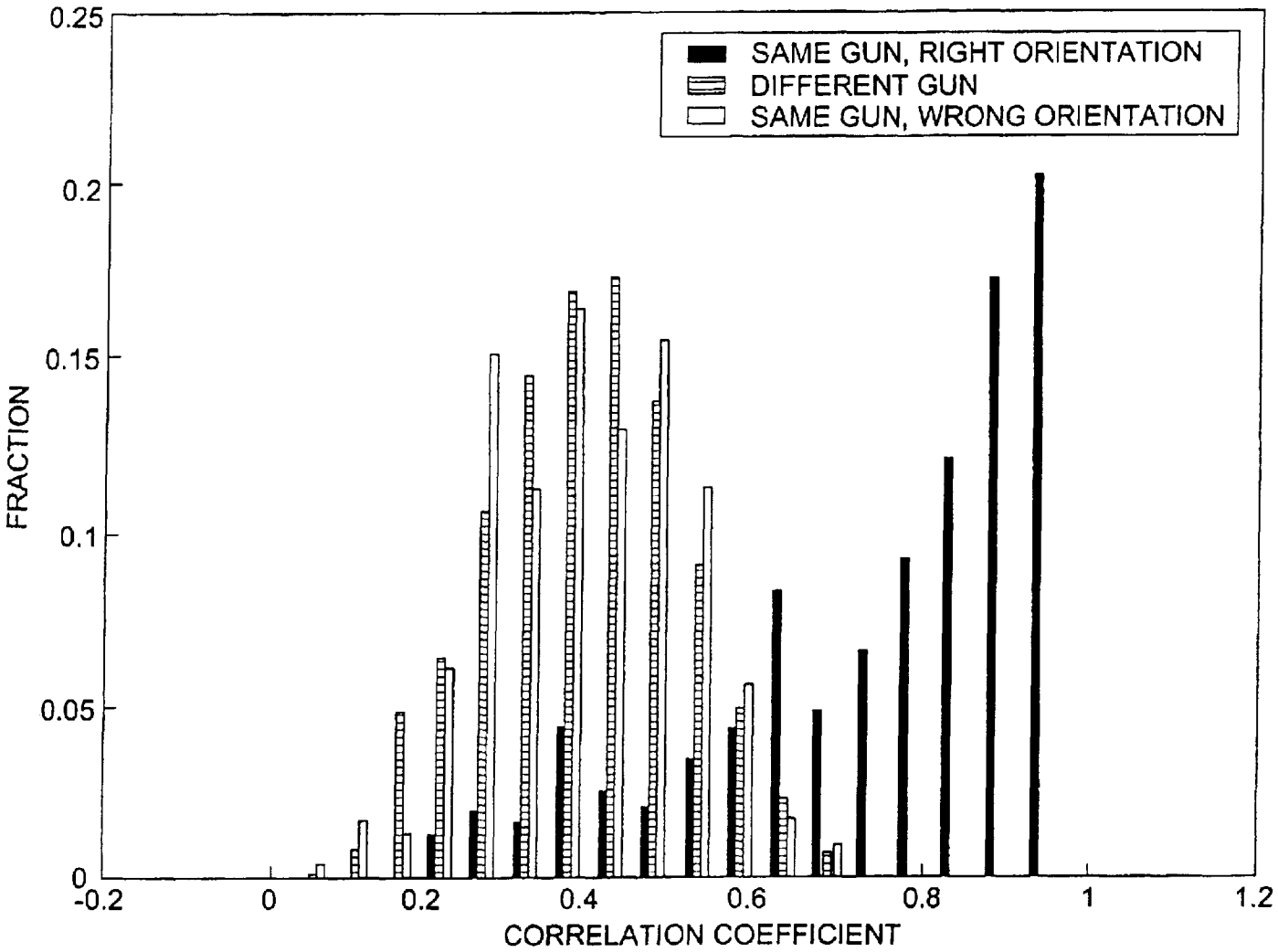
FIG. 5 is a histogram depicting matching coefficients, different-gun coefficients and same-gun non-matching coefficients computed for a number of possible bullet comparisons.

The three different sets of correlation coefficients, i.e. matching (same gun, right orientation) coefficients, different-gun coefficients and same-gun non-matching (same gun, wrong orientation) coefficients were computed for a number of the possible bullet comparisons as described above. The results of these comparisons are plotted in the histogram depicted in FIG. 5, and some of the basic statistical properties of the three different sets of correlation coefficients are tabulated in the table depicted in FIG. 6. It is seen from FIGS. 5 and 6 that the distributions of different-gun coefficients and same-gun non-matching (same gun, wrong orientation) coefficients appear to be normally distributed. In contrast, the distribution of matching (same gun, right orientation) coefficients appears not to be normally distributed. Rather, the matching coefficients display a markedly negatively skewed distribution, where mean-median/standard deviation=−0.35. The mean values and standard deviations for different-gun coefficients and same-gun non-matching coefficients are nearly identical and their distributions look very similar. The values attained by matching coefficients are on average higher than those attained by either different-gun coefficients or same-gun non-matching coefficients. The distribution of matching coefficients appears to be significantly different than the distributions of both different-gun and same-gun non-matching coefficients.

The following hypotheses were tested for statistically:

$H_0$: The probability distributions from which the samples arose are not different from a normal distribution.

$H_1$: The distribution is different from normal.

A one-sample Kolmogorov-Smirnov (KS) test, as conventionally known in the field of statistics, was performed comparing the samples to a normal distribution. A two-tailed test was performed to assess differences for all sample values. The outcomes of the KS test for significance levels $\alpha$=0.01, 0.05 and 0.1 and the three sets of correlation coefficients are listed in the table depicted in FIG. 7. For these significance levels, the normality hypothesis $H_0$ for the different-gun coefficients and for the same-gun non-matching (same gun, wrong orientation) coefficients cannot be rejected. On the other hand, normality (hypothesis $H_0$) is rejected for the matching (same gun, right orientation) coefficients.

In another aspect of the example, an evaluation was performed to determine whether the same-gun non-matching (same gun, wrong orientation) coefficients are statistically indistinguishable from the different-gun coefficients. A two-sample Kolmogorov-Smirnov (KS) test, conventionally known in the field of statistics for comparing two data sets to evaluate whether they were sampled from probability distributions of the same characteristics, were performed to test for the following hypotheses:

$H_2$: The probability distributions from which the samples arose are not different from one another.

$H_3$: The samples arose from different probability distributions.

A two-tailed test was performed using two sets of data, i.e. different-gun coefficients and same-gun non-matching (same gun, wrong orientation) coefficients. The outcomes of the KS test for significance levels of $\alpha$=0.01, 0.05 and 0.1 are listed in the table depicted in FIG. 8. For these significance levels, the hypothesis $H_2$ that the probability distributions from which the samples arose are not different from one another cannot be rejected. In other words, for these significance levels, the distributions of the same-gun non-matching (same gun, wrong orientation) coefficients and the different-gun coefficients are statistically indistinguishable.

Another test commonly used in the field of statistics to compare two samples is the Rank-Sum test. The Rank-Sum test is a non-parametric test that does not depend on the normality assumption of the tested data. The Rank-Sum test was performed for the different-gun coefficients and the same-gun non-matching (same gun, wrong orientation) coefficients with respect to hypotheses $H_2$ and $H_3$. The outcome of the Rank-Sum test is the probability of wrongly rejecting $H_2$, also called the p-value. Applying the Rank-Sum test to the different-gun coefficients and the same-gun non-matching (same gun, wrong orientation) coefficients, p=0.88. Again, the hypothesis $H_2$ that the different-gun coefficients and the same-gun non-matching (same gun, wrong orientation) coefficients have the same underlying distribution cannot be rejected.

In a further aspect of the example, formal statistical testing was conducted to verify that the distribution of the matching (same gun, right orientation) coefficients and the distribution of the different-gun coefficients are significantly different. The same Kolmogorov-Smirnov (KS) test performed for the different-gun coefficients and the same-gun non-matching (same gun, wrong orientation) coefficients was performed for the two sets of matching (same gun, right orientation) coefficients and different-gun coefficients. The results of this test for significance levels $\alpha$=0.01, 0.05 and 0.10 are tabulated in FIG. 9. For these significance levels, the hypothesis $H_2$ that the probability distribution from which the samples arose are not different from one another is rejected. In other words, the distributions for the different-gun coefficients and the matching (same gun, right orientation) coefficients are dissimilar.

The example described above confirms statistically that the distributions of different-gun coefficients and same-gun non-matching (same gun, wrong orientation) coefficients appear to be normally distributed, that the distribution of matching (same gun, right orientation) coefficients appears not to be normally distributed, that the mean values and standard deviations for different-gun coefficients and same-gun non-matching (same gun, wrong orientation) coefficients are similar, that the values attained by matching (same gun, right orientation) coefficients are on average higher than those attained by either different-gun coefficients or same-gun non-matching (same gun, wrong orientation) coefficients, and that the distribution of matching (same gun, right orientation) coefficients is different from the distribution of both different-gun and same-gun non-matching (same gun, wrong orientation) coefficients.

When a firearms examiner is called upon to determine manually whether an evidence bullet was fired by a suspect gun, the objective is to classify the evidence bullet in one of two ways: 1) the evidence bullet was fired by the suspect gun or 2) the evidence bullet was fired by a different gun. This process involves two distinct phases. After firing a number of control bullets with the suspect gun, the first phase involves a manual comparison between the control bullets themselves. If the control bullets do not show convincingly repeatable features, a comparison between the control bullets and the evidence bullet will probably be unreliable and inconclusive. On the other hand, if the features found on the control bullets are repeatable, it is to be expected that any other bullet fired by the same gun would display the same features. In the first phase, therefore, the firearms examiner attempts to assess the identifiability or individuality of the suspect gun by evaluating the repeatability of the features found on the control bullets fired by the suspect gun. If repeatable features are indeed found on the control bullets, the gun is considered identifiable and the examiner will proceed to the second phase. The first phase, therefore, may be referred to as the gun identifiability phase. In the second phase, the evidence bullet is inspected manually for features similar to those found on the control bullets. The presence of these features on the evidence bullet would lead to the conclusion that the evidence bullet was fired by the suspect gun and, therefore, a positive classification. The absence of these features on the evidence bullet would lead to a negative classification. The second phase may be referred to as the bullet-to-gun classification phase. The automated system and methods of the present invention emulate this two-phase approach in the sense that gun identifiability and bullet-to-gun classification are differentiated. With the system and methods of the present invention, gun identifiability may be accomplished with or without bullet-to-gun classification, and bullet-to-gun classification may be accomplished with or without gun identifiability.

Assessment of gun identifiability involves determining whether the impressions produced by a gun's barrel reproduce sufficiently well on all bullets fired by it. Typically, a firearms examiner would fire a number of control bullets and by manual inspection determine if the striations found on the surfaces of the control bullets are reproduced from control bullet to control bullet. The firearms examiner must first identify the matching relative orientation between every pair of control bullets and then subjectively evaluate the degree of similarity of the matching impressions as compared to the non-matching impressions. In the system and methods of the present invention, this process is automated and performed using matching coefficients and non-matching coefficients, either same-gun non-matching coefficients or different-gun coefficients. Given a group of at least two control bullets fired by the suspect gun, if the sets of matching coefficients and non-matching coefficients are statistically indistinguishable, it is not possible to identify an actual matching relative orientation between pairs of bullets from this group. If an actual matching relative orientation between bullets from the control group cannot be determined, matching the control bullets among themselves is not possible. If the control bullets fired by the suspect gun cannot be matched, matching the evidence bullet to the control bullets is highly unlikely, thereby rendering the gun non-identifiable.

In the system and methods of the present invention, the following computer-automated automated procedure may be used to determine whether a gun is identifiable:

1) Given a suspect gun with k rifling impressions, fire m control bullets (m to be determined according to a desired level of significance but including at least two control bullets).
2) After acquiring all control bullets, compute all correlation coefficient matrices $S(I_i, I_j)$, $1 \leqq i, j \leqq k$, $i \neq j$ between the land impressions for all control bullets.
3) Create two sets of correlation coefficients:
   a) Matching coefficients (labeled r). This set will have $$n \times \left(\frac{m!}{(m-2)! \times 2!}\right) \times k$$

elements, assuming that all land impressions in all control bullets are acquired.
   b) Non-matching coefficients, such as same-gun non-matching coefficients (labeled w). This set will have $$n \times \left(\frac{m!}{(m-2)! \times 2!}\right) \times k$$

elements, assuming that all land impressions in all control bullets are acquired.
4) Perform a statistical test to evaluate the following hypotheses:
   $H_2$: The probability distributions from which the samples arose are not different from one another.
   $H_3$: The samples arose from different probability distributions.
5) As a result of the statistical test, obtain an estimate of the probability of error associated with rejecting hypothesis $H_2$ (p-value). If the obtained p-value is lower than a pre-established significance level, the gun will be considered identifiable. If the obtained p-value exceeds the pre-established significance level, the gun will be considered non-identifiable.

The statistical test performed in step 4 is preferably a Rank-Sum test as described in the example above. The p-value attained via this test provides an estimate of the probability of obtaining the computed set of matching coefficients (labeled r) if the phenomenon that generated these coefficients has the same statistical distribution as that which generated the non-matching coefficients (labeled w). The lower the computed p-value, the greater the statistical difference between the sets of matching and non-matching coefficients, and the higher the confidence that the gun in question is identifiable. The computed p-value can thusly be employed as an estimate of the probability of error in concluding that the suspect gun is identifiable. Of course, steps 1–5 above are performed after acquiring land impression data for the control bullets as discussed above.

Steps 1 through 5 above may be further represented in connection with a specific example:

1) There are 5 bullets available, fired by a suspect gun, with 6, 6, 6, 4 and 6 land impressions, respectively, for which 3-D depth profiles have been acquired.
2) Compute the matrices $S(i_i, I_j)$, $1 \leqq i, j \leqq k$, $i \neq j$. of correlation coefficients for each bullet pair.
3) Create two sets of coefficients: a set of matching coefficients (labeled r) and a set of same-gun non-matching coefficients (labeled w). In this particular case, these sets have 52 elements each.
4) Perform a Rank-Sum test for sets r and w to evaluate the degree of similarity of their distributions. The p-value obtained, $p=3 \cdot 10^{-13}$ or effectively zero, estimates the probability that the two sets of data originated from the same underlying distribution. Such a low p-value indicates strong dissimilarities between r and w.
5) Conclude that given 5 control bullets, the suspect gun is identifiable. The p-value depends on the amount of data, i.e. control bullets, used in the test. For instance, for 2 control bullets with 5 land impressions each, r and w consist of only 5 elements each. A typical p-value is then $p \sim 10^{-2}$.

As pointed out above, the non-matching coefficients could be different-gun coefficients obtained by computing a set of correlation coefficients for two or more bullets fired by different guns of the same manufacture and model as the suspect gun in all possible relative orientations and identifying the different-gun coefficients corresponding to the row of coefficients for the relative orientation of greatest similarity or match, for example the row having the highest mean correlation coefficient.

The question of bullet-to-gun classification is equivalent to asking whether the degree of similarity between the evidence bullet and the control bullets in the presumed matching relative orientation warrants the conclusion that both the evidence bullet and the control bullets were fired by the same gun. In order to make such a determination, a firearms examiner would manually compare the evidence bullet against the control bullets and attempt to identify matching orientations between them. Assuming that such orientations are identified, the firearms examiner would subjectively assess whether the degree of similarity between the evidence bullet and the control bullets warrants the conclusion that all of the bullets were fired by the same gun. The firearms examiner should not only consider the degree of similarity between the evidence and control bullets, but should contrast this degree of similarity with that achievable by chance among different guns of the same model. To do this effectively, the firearms examiner must have accumulated considerable experience with a vast number of different guns.

In accordance with the present invention, the bullet-to-gun classification process is performed automatically using matching coefficients and questioned coefficients and may also utilize non-matching coefficients, either different-gun coefficients or same-gun non-matching coefficients. However, due to the fact that compiling a database of different-gun coefficients is a significant undertaking because it would require obtaining and comparing control bullets from a large number of guns of the same model as the suspect gun, the process may be performed automatically in accordance with the present invention relying on the similarity of the distributions of different-gun coefficients and same-gun non-matching coefficients. In order to conclude that the evidence bullet and the control bullets were fired by the same gun, the distribution of the correlation coefficients obtained by comparing the evidence bullet against the control bullets in their presumed matching relative orientations, i.e. the questioned coefficients, should be significantly more similar to the distribution of the matching coefficients obtained by comparing the control bullets among themselves than to the distribution of different-gun coefficients as pointed out above. Because of the above-noted difficulties associated with obtaining a representative set of different-gun coefficients, the distribution of different-gun coefficients may be approximated with the distribution of control bullet same-gun non-matching coefficients since, as explained above, the distributions of different-gun coefficients and same-gun non-matching coefficients are statistically undistinguishable.

In the system and methods of the present invention, the following computer-automated procedure may be used for bullet-to-gun classification:

1) Given a suspect gun with k rifling impressions, fire m control bullets (m to be determined according to a desired significance level but including at least two control bullets).
2) After acquiring all control bullets, compute all correlation coefficient matrices $S(I_i,I_j)$, $1 \leqq i, j \leqq k$, $i \neq j$ between the land impressions for all control bullets, and compute all correlation coefficients between the land impressions for the control bullets and the land impressions for an evidence bullet(s).
3) Create three sets of correlation coefficients:
   a) Control bullet matching coefficients (labeled r). This set will have $$n \times \left(\frac{m!}{(m-2)! \times 2!}\right) \times k$$

elements, assuming that all control bullets are acquired.
   b) Non-matching coefficients, such as control bullet same-gun non-matching coefficients (labeled w). This set will have $$n \times \left(\frac{m!}{(m-2)! \times 2!}\right) \times k$$

elements, assuming that all land impressions in all control bullets are acquired.
   c) Control bullet vs. evidence bullet questioned coefficients (labeled e). This set will have m×k elements (assuming a single evidence bullet).
4) Perform statistical tests to evaluate the following hypotheses:
   a) Using sets r and e, are these two sets of data statistically equivalent? Obtain p-value (labeled $p_r$).
   b) Using sets w and e, are these two sets of data statistically equivalent? Obtain p-value (labeled $p_w$).
5) Accept the hypothesis associated with the smallest of the p-values, i.e. if $p_r/p_w<Y$, classify the evidence bullet a nd suspect gun as a non-match, while if $p_r/p_w \geqq y$, classify the evidence bullet and suspect gun as a match.

The set of questioned coefficients is obtained in the same manner as the matching coefficients, i.e. by comparing the land impressions of the evidence bullet(s) to the land impressions of each control bullet in all possible relative orientations, computing correlation coefficients for each land impression comparison, and identifying the correlation coefficients for the relative orientation(s) of greatest similarity or match.

Due to the fact that the distribution of matching coefficients is not normal, the p-values are preferably obtained in step 4 using a Rank-Sum test. These p-values, i.e. $P_r$ and $p_w$, are used to resolve the classification question by determining whether the distribution of correlation coefficients in set e is more similar to that of the matching coefficients (set r) than to that of the non-matching coefficients (set w). In the former case, $p_r/p_w \geqq y$ for a pre-established $1 \leqq y$, while in the latter case $p_r/p_w<Y$. These p-values are not only used to classify the evidence bullet but also to provide an estimate of the probability of misclassification. The value $p_r$ is an estimator for the probability of a false positive if the evidence bullet was classified as a match with the suspect gun. The value $p_w$ is an estimator for the probability of a false negative if the evidence bullet was classified as a non-match with the suspect gun. Of course, steps 1–5 of the bullet-to-gun classification procedure are performed after acquiring land impression data for the control bullets and the evidence bullet(s) as discussed above.

The above-described method of bullet-to-gun classification is represented further in connection with the following example:

1) There are 5 bullets available, fired by a suspect gun, with 6, 6, 6, 4 and 6 land impressions, respectively, for which 3-D depth profiles have been acquired.
2) Compute the matrices $S(I_i,I_j)$, $1 \leqq i, j \leqq k$, $i \neq j$ of correlation coefficients for each bullet pair. Compute the matrices $S(I_i,I_e)$, $1 \leqq i \leqq k$ and the index e refers to the evidence bullet.
3) Create three sets of coefficients: a set of control bullet matching coefficients (labeled r, 52 elements), a set of control bullet same-gun non-matching coefficients (labeled w, 52 elements), and a set of control bullet vs. evidence bullet questioned coefficients (labeled e, 28 elements).
4) Perform the following Rank-Sum tests:
   a) Between sets r and e and obtain $p_r$. In this particular example, the obtained p-value was $p_r=3.4 \cdot 10^{-8}$.
   b) Between sets w and e and obtain $p_w$. In this particular example, $p_w=0.06$.
5) Given the lowest possible value y=1, reject the hypothesis that the evidence bullet was fired by the suspect gun. For this many control bullets, with high quality markings, the classification is a near certainty.

The above example considered the case of an evidence bullet that did not match the suspect gun in question. To illustrate a bullet-to-gun matching pair, the example can be performed using one of the control bullets as the evidence bullet, with the remaining 4 control bullets constituting the control bullets. Sets r and w will have 30 elements each, and set e will contain 22 elements. The Rank-Sum tests yield $p_r=0.415$ and $p_w=5.2 \times 10^{-7}$. Since $p_r/p_w \geqq y$ the hypothesis that the suspect gun did not fire the evidence bullet is rejected, resulting in the conclusion that the evidence bullet was fired by the suspect gun. Of course, a set of different-gun coefficients can be used as the non-matching coefficients in place of the same-gun non-matching coefficients.

The ballistic analysis system and methods of the present invention provide an automated procedure for objectively evaluating the identifiability of guns as well as bullet-to-gun classifications. In addition, the system and methods of the present invention permit a probable error rate for gun identifiability and for bullet-to-gun classification to be estimated, particularly the probability of a false positive match in bullet-to-gun classifications. The probability of false-positive identifications may be decreased with an increased number of usable impressions in both the evidence bullet and the control bullets and/or by using an increased number of control bullets. It should be appreciated that any of the depth profile information and/or correlation coefficients may be stored in the databases of the computerized system and methods of the present invention.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A computerized system for ballistic analysis comprising means for comparing land impressions on the surfaces of a plurality of control bullets, fired by a suspect gun, to one another in all possible relative orientations for the control bullets;

means for computing a correlation coefficient for each land-to-land comparison between the control bullets;

means for identifying a set of matching coefficients corresponding to the correlation coefficients for each pair of the control bullets in a relative orientation of greatest match;

means for identifying a set of non-matching coefficients;

means for statistically evaluating whether or not the sets of matching coefficients and non-matching coefficients are statistically undistinguishable; and means for concluding the suspect gun is identifiable in response to a statistical evaluation that the sets of matching coefficients and non-matching coefficients are not statistically undistinguishable.

2. The computerized system for ballistic analysis recited in claim 1 and further comprising a data acquisition unit adapted to acquire land impression data for the control bullets and wherein said means for comparing comprises means for comparing the acquired land impression data.

3. The computerized system for ballistic analysis recited in claim 2 wherein said data acquisition unit is adapted to acquire 3-D depth profiles of the land impressions and wherein said means for comparing comprises means for comparing the acquired depth profiles.

4. The computerized system for ballistic analysis recited in claim 3 and further comprising means for isolating features of the land impressions within intermediate length scales.

5. The computerized system for ballistic analysis recited in claim 4 wherein said means for isolating includes means for filtering the acquired depth profiles.

6. The computerized system for ballistic analysis recited in claim 3 and further comprising normalization means for compensating the depth profiles for measurement errors to obtain normalized depth profiles and wherein said means for comparing comprises means for comparing the normalized depth profiles.

7. The computerized system for ballistic analysis recited in claim 1 wherein said means for computing includes means for generating a quantitative measurement of the degree of similarity between the land impressions under comparison.

8. The computerized system for ballistic analysis recited in claim 1 wherein said means for identifying a set of matching coefficients comprises means for identifying the correlation coefficients for each pair of the control bullets in the relative orientation having the highest mean correlation coefficient.

9. The computerized system for ballistic analysis recited in claim 1 wherein said means for identifying a set of non-matching coefficients comprises means for identifying a set of same-gun non-matching coefficients corresponding to the correlation coefficients in which each pair of the control bullets is in a non-matching relative orientation represented by a relative orientation of less than greatest match.

10. The computerized system for ballistic analysis recited in claim 9 wherein said means for identifying a set of same-gun non-matching coefficients comprises means for identifying the correlation coefficients for each pair of the control bullets in a non-matching relative orientation having the highest mean correlation coefficient.

11. The computerized system for ballistic analysis recited in claim 1 wherein said means for identifying a set of non-matching coefficients comprises means for identifying a set of different-gun coefficients corresponding to the correlation coefficients for a plurality of different-gun bullets, fired by a gun of the same model as the suspect gun, in a relative orientation of greatest match.

12. The computerized system for ballistic analysis recited in claim 1 wherein said means for statistically evaluating includes means for evaluating the degree of similarity of the distributions for the sets of matching coefficients and non-matching coefficients.

13. The computerized system for ballistic analysis recited in claim 12 wherein said means for statistically evaluating includes means for performing a Rank-Sum test using the sets of matching coefficients and non-matching coefficients.

14. The computerized system for ballistic analysis recited in claim 12 wherein said means for statistically evaluating includes means for obtaining a p-value and said means for concluding includes means for comparing the p-value to a pre-established significance level.

15. The computerized system for ballistic analysis recited in claim 1 wherein said means for concluding includes means for estimating the probability of error of concluding that the suspect gun is identifiable.

16. The computerized system for ballistic analysis recited in claim 1 wherein said means for comparing includes means for comparing groove impressions on the surfaces of the control bullets to one another in all possible relative orientations for the control bullets.

17. A computerized system for ballistic analysis comprising means for comparing land impressions on the surfaces of a plurality of control bullets, fired by a suspect gun, to one another in all possible relative orientations for the control bullets;

means for computing a correlation coefficient for each land-to-land comparison between the control bullets;

means for comparing land impressions on the surface of an evidence bullet with the land impressions on each of the control bullets in all possible relative orientations for the evidence bullet and the control bullets, respectively;

means for computing a correlation coefficient for each land-to-land comparison between the evidence bullet and the control bullets, respectively;

means for identifying a set of matching coefficients corresponding to the correlation coefficients for each pair of the control bullets in a relative orientation of greatest match;

means for identifying a set of questioned coefficients for the evidence bullet and the control bullets corresponding to the correlation coefficients in which the evidence bullet is in a relative orientation of greatest match with each of the control bullets, respectively;

means for statistically evaluating whether or not the set of matching coefficients is statistically equivalent to the set of questioned coefficients; and means for concluding the evidence bullet was fired by the suspect gun in response to a statistical evaluation that the sets of matching coefficients and questioned coefficients are statistically equivalent.

18. The computerized system for ballistic analysis recited in claim 17 and further comprising a data acquisition unit adapted to acquire land impression data for the control bullets and the evidence bullet and wherein said means for comparing comprises means for comparing the acquired land impression data.

19. The computerized system for ballistic analysis recited in claim 18 wherein said data acquisition unit is adapted to acquire 3-D depth profiles of the land impressions and wherein said means for comparing comprises means for comparing the acquired depth profiles.

20. The computerized system for ballistic analysis recited in claim 19 and further comprising means for isolating features of the land impressions within intermediate length scales.

21. The computerized system for ballistic analysis recited in claim 20 wherein said means for isolating includes means for filtering the acquired depth profiles.

22. The computerized system for ballistic analysis recited in claim 19 and further comprising normalization means for compensating the acquired depth profiles for measurement errors to obtain normalized depth profiles and said means for comparing comprises means for comparing the normalized depth profiles.

23. The computerized system for ballistic analysis recited in claim 17 wherein said means for computing a correlation coefficient for each land-to-land comparison between the control bullets and said means for computing a correlation coefficient for each land-to-land comparison between the evidence bullet and the control bullets, respectively, comprise means for generating a quantitative measure of the degree of similarity between the land impressions under comparison.

24. The computerized system for ballistic analysis recited in claim 17 wherein said means for identifying a set of matching coefficients comprises means for identifying the correlation coefficients for each pair of the control bullets corresponding to the relative orientation having the highest mean correlation coefficient, and said means for identifying a set of questioned coefficients comprises means for identifying the correlation coefficients for the relative orientations between the evidence bullet and each of the control bullets, respectively, having the highest mean correlation coefficients.

25. The computerized system for ballistic analysis recited in claim 17 wherein said means for statistically evaluating includes means for evaluating the degree of similarity of the distributions for the sets of matching coefficients and questioned coefficients.

26. The computerized system for ballistic analysis recited in claim 25 wherein said means for statistically evaluating includes means for performing a Rank-Sum test using the sets of matching coefficients and questioned coefficients.

27. The computerized system for ballistic analysis recited in claim 17 and further comprising means for identifying a set of non-matching coefficients, means for statistically evaluating whether or not the set of non-matching coefficients is statistically equivalent to the set of questioned coefficients, and wherein said means for concluding comprises means for concluding the evidence bullet was not fired by the suspect gun in response to a statistical evaluation that the sets of non-matching coefficients and questioned coefficients are statistically equivalent.

28. The computerized system for ballistic analysis recited in claim 27 wherein said means for statistically evaluating whether or not the set of matching coefficients is statistically equivalent to the set of questioned coefficients comprises means for performing a Rank-Sum test using the sets of matching coefficients and questioned coefficients to obtain a first p-value, said means for statistically evaluating whether or not the set of non-matching coefficients is statistically equivalent to the set of questioned coefficients comprises means for performing a Rank-Sum test using the sets of non-matching coefficients and questioned coefficients to obtain a second p-value and said means for concluding includes means for comparing the value obtained by dividing the first p-value by the second p-value to a pre-established significance level.

29. The computerized system for ballistic analysis recited in claim 27 wherein said means for identifying a set of non-matching coefficients comprises means for identifying a set of control bullet same-gun non-matching coefficients corresponding to the correlation coefficients for each pair of the control bullets in a non-matching relative orientation of less than greatest match.

30. The computerized system for ballistic analysis recited in claim 29 wherein said means for identifying a set of control bullet same-gun non-matching coefficients comprises means for identifying the correlation coefficients for each pair of the control bullets in a non-matching relative orientation having the highest mean correlation coefficient.

31. The computerized system for ballistic analysis recited in claim 27 wherein said means for identifying a set of non-matching coefficients comprises means for identifying a set of different-gun coefficients corresponding to the correlation coefficients for a plurality of different-gun bullets, fired by a gun of the same model as the suspect gun, in a relative orientation of greatest match.

32. The computerized system for ballistic analysis recited in claim 17 wherein said means for concluding includes means for estimating the probability of error of concluding that the evidence bullet was fired by the suspect gun.

33. A computerized system for ballistic analysis comprising means for comparing land impressions on the surfaces of a plurality of control bullets, fired by a suspect gun, to one another in all possible relative orientations for the control bullets;

means for computing a correlation coefficient for each land-to-land comparison;

means for identifying a set of matching coefficients corresponding to the correlation coefficients for each pair of the control bullets in a relative orientation of greatest match;

means for identifying a set of same-gun non-matching coefficients corresponding to the correlation coefficients for each pair of the control bullets in a non-matching relative orientation of less than greatest match;

means for statistically evaluating whether or not the sets of matching coefficients and same-gun non-matching coefficients are statistically undistinguishable;

means for concluding the suspect gun is identifiable in response to a statistical evaluation that the sets of matching coefficients and same-gun non-matching coefficients are not statistically undistinguishable;

means for comparing land impressions on the surface of an evidence bullet with the land impressions on each of the control bullets in all possible relative orientations between the evidence bullet and the control bullets, respectively;

means for computing a correlation coefficient for each land-to-land comparison between the evidence bullet and the control bullets, respectively;

means for identifying a set of questioned coefficients for the evidence bullet and the control bullets corresponding to the correlation coefficients in which the evidence bullet is in a relative orientation of greatest match with each of the control bullets, respectively;

means for statistically evaluating whether or not the set of matching coefficients is statistically equivalent to the set of questioned coefficients;

means for statistically evaluating whether or not the set of same-gun non-matching coefficients is statistically equivalent to the set of questioned coefficients; and means for concluding the evidence bullet was fired by the suspect gun in response to a statistical evaluation that the set of questioned coefficients is more statistically similar to the set of matching coefficients than to the set of same-gun non-matching coefficients.

34. A method of computerized ballistic analysis comprising the steps of comparing land impressions on the surfaces of a plurality of control bullets, fired by a suspect gun, to one another in all possible relative orientations for the control bullets;

computing a correlation coefficient for each land-to-land comparison;

identifying a set of matching coefficients corresponding to the correlation coefficients in which each pair of the control bullets is in a relative orientation of greatest match;

identifying a set of non-matching coefficients;

statistically evaluating whether or not the sets of matching coefficients and non-matching coefficients are statistically undistinguishable; and concluding the suspect gun is identifiable in response to a statistical evaluation that the sets of matching coefficients and non-matching coefficients are not statistically undistinguishable.

35. The method of computerized ballistic analysis recited in claim 34 wherein said step of comparing includes comparing 3-D depth profiles of the land impressions.

36. The method of computerized ballistic analysis recited in claim 35 wherein said step of comparing includes comparing fine details of the depth profiles for the land impressions.

37. The method of computerized ballistic analysis recited in claim 34 wherein said step of comparing further includes comparing groove impressions on the surfaces of the control bullets to one another in all possible relative orientations for the control bullets.

38. The method of computerized ballistic analysis recited in claim 35 wherein said step of comparing includes isolating features of the land impressions within intermediate length scales.

39. The method of computerized ballistic analysis recited in claim 35 and further comprising, prior to said step of comparing, the step of normalizing the depth profiles for measurement errors.

40. The method of computerized ballistic analysis recited in claim 34 wherein said step of identifying a set of matching coefficients comprises identifying the correlation coefficients for each pair of the control bullets in the relative orientation having the highest mean correlation coefficient.

41. The method of computerized ballistic analysis recited in claim 34 wherein said step of identifying a set of non-matching coefficients comprises identifying a set of same-gun non-matching coefficients for each pair of the control bullets in a non-matching relative orientation of less than greatest match.

42. The method of computerized ballistic analysis recited in claim 41 wherein said step of identifying a set of same-gun non-matching coefficients comprises identifying the correlation coefficients for each pair of the control bullets in the non-matching relative orientation having the highest mean correlation coefficient.

43. The method of computerized ballistic analysis recited in claim 34 wherein said step of identifying a set of non-matching coefficients includes identifying a set of different-gun coefficients corresponding to the correlation coefficients for at least one pair of bullets fired by a gun of the same model as the suspect gun in a relative orientation of greatest match.

44. The method of computerized ballistic analysis recited in claim 34 wherein said step of statistically evaluating includes the steps of performing a Rank-Sum test using the sets of matching coefficients and non-matching coefficients to obtain a p-value and said step of concluding includes comparing the p-value to a pre-established significance level.

45. The method of computerized ballistic analysis recited in claim 34 and further including the step of estimating the probability of error of concluding that the suspect gun is identifiable.

46. A method of computerized ballistic analysis comprising the steps of comparing land impressions on the surfaces of a plurality of control bullets, fired by a suspect gun, to one another in all possible relative orientations for the control bullets;

computing a correlation coefficient for each land-to-land comparison between the control bullets;

comparing land impressions on the surface of an evidence bullet with the land impressions on each of the control bullets in all possible relative orientations between the evidence bullet and the control bullets, respectively;

computing a correlation coefficient for each land-to-land comparison between the evidence bullet and the control bullets, respectively;

identifying a set of matching coefficients for the control bullets corresponding to the correlation coefficients in which each pair of the control bullets is in a relative orientation of greatest match;

identifying a set of questioned coefficients for the evidence bullet and the control bullets corresponding to the correlation coefficients in which the evidence bullet is in a relative orientation of greatest match with each of the control bullets, respectively;

statistically evaluating whether or not the set of matching coefficients is statistically equivalent to the set of questioned coefficients; and concluding the evidence bullet was fired by the suspect gun in response to a statistical evaluation that the sets of matching coefficients and questioned coefficients are statistically equivalent.

47. The method of computerized ballistic analysis recited in claim 46 and further comprising, prior to said steps of comparing, the step of acquiring 3-D depth profiles of the land impressions of the control bullets and the evidence bullet, and said steps of comparing comprise comparing the acquired depth profiles.

48. The method of computerized ballistic analysis recited in claim 47 wherein said step of acquiring comprises acquiring depth profiles including fine details within the land impressions and said steps of comparing comprise comparing the fine details.

49. The method of computerized ballistic analysis recited in claim 47 and further comprising, prior to said steps of comparing, the step of isolating features of the depth profiles of the land impressions within intermediate length scales.

50. The method of computerized ballistic analysis recited in claim 47 and further comprising, prior to said steps of comparing, the step of normalizing the acquired depth profiles for measurement errors.

51. The method of computerized ballistic analysis recited in claim 46 wherein said steps of comparing further include comparing groove impressions on the surfaces of the control bullets.

52. The method of computerized ballistic analysis recited in claim 46 wherein said step of identifying a set of matching coefficients comprises identifying the correlation coefficients for each pair of the control bullets in the relative orientation having the highest mean correlation coefficient.

53. The method of computerized ballistic analysis recited in claim 46 wherein said step of identifying a set of questioned coefficients comprises identifying the correlation coefficients for the relative orientation between the evidence bullet and each of the control bullets having the highest mean correlation coefficient, respectively.

54. The method of computerized ballistic analysis recited in claim 46 wherein said step of statistically evaluating includes statistically evaluating the degree of similarity of the distributions for the sets of matching coefficients and questioned coefficients.

55. The method of computerized ballistic analysis recited in claim 54 wherein said step of statistically evaluating includes performing a Rank-Sum test using the sets of matching coefficients and questioned coefficients.

56. The method of computerized ballistic analysis recited in claim 46 and further comprising the steps of identifying a set of non-matching coefficients, statistically evaluating whether or not the set of non-matching coefficients is statistically equivalent to the set of questioned coefficients and wherein said step of concluding comprises concluding the evidence bullet was not fired by the suspect gun in response to a statistical evaluation that the sets of non-matching coefficients and questioned coefficients are statistically equivalent.

57. The method of computerized ballistic analysis recited in claim 56 wherein said step of identifying a set of non-matching coefficients comprises identifying a set of same-gun non-matching coefficients for the control bullets corresponding to the correlation coefficients in which each pair of the control bullets is in a non-matching relative orientation of less than greatest match.

58. The method of computerized ballistic analysis recited in claim 56 wherein said step of identifying a set of non-matching coeffcients includes identifying a set of different-gun coefficients corresponding to the correlation coefficients for at least one pair of bullets fired by a gun of the same model as the suspect gun in a relative orientation of greatest match.

59. The method of computerized ballistic analysis recited in claim 56 wherein said step of statistically evaluating whether or not the set of matching coefficients is statistically equivalent to the set of questioned coefficients includes performing a Rank-Sum test using the sets of matching coefficients and questioned coefficients to obtain a first p-value, said step of statistically evaluating whether or not the set of non-matching coefficients is statistically equivalent to the set of questioned coefficients includes performing a Rank-Sum test using the sets of non-matching coefficients and questioned coefficients to obtain a second p-value, and said step of concluding includes dividing the first p-value by the second p-value to obtain a resultant value and comparing the resultant value to a pre-established significance level.

60. The method of computerized ballistic analysis recited in claim 46 and further including the step of estimating the probability of error of concluding that the evidence bullet was fired by the suspect gun.

61. A method of computerized ballistic analysis comprising the steps of comparing land impressions on the surfaces of a plurality of control bullets, fired by a suspect gun, to one another in all possible relative orientations for the control bullets;

computing a correlation coefficient for each land-to-land comparison;

identifying a set of matching coefficients corresponding to the correlation coefficients in which each pair of the control bullets is in a relative orientation of greatest match;

identifying a set of same-gun non-matching coefficients corresponding to the correlation coefficients in which each pair of the control bullets is in a non-matching relative orientation of less than greatest match;

statistically evaluating whether or not the sets of matching coefficients and same-gun non-matching coefficients are statistically undistinguishable;

concluding the suspect gun is identifiable in response to a statistical evaluation that the sets of matching coefficients and same-gun non-matching coefficients are not statistically undistinguishable;

comparing land impressions on the surface of an evidence bullet with the land impressions on each of the control bullets in all possible relative orientations between the evidence bullet and each of the control bullets, respectively;

computing a correlation coefficient for each land-to-land comparison between the evidence bullet and each of the control bullets, respectively;

identifying a set of questioned coefficients for the evidence bullet and the control bullets corresponding to the correlation coefficients in which the evidence bullet is in a relative orientation of greatest match with each of the control bullets, respectively;

statistically evaluating whether or not the set of matching coefficients is statistically equivalent to the set of questioned coefficients;

statistically evaluating whether or not the set of same-gun non-matching coefficients is statistically equivalent to the set of questioned coefficients; and concluding the evidence bullet was fired by the suspect gun in response to a statistical evaluation that the sets of matching coefficients and questioned coefficients are more statistically similar than the sets of same-gun non-matching coefficients and questioned coefficients.

* * * * *